US005130724A

United States Patent [19]

Crowley

[11] Patent Number: 5,130,724

[45] Date of Patent: Jul. 14, 1992

[54] SYSTEM AND METHOD FOR DIRECTLY FEEDING PAPER TO PRINTING DEVICES

[75] Inventor: H. W. Crowley, Newton, Mass.

[73] Assignee: Roll Systems, Inc., Burlington, Mass.

[21] Appl. No.: 536,214

[22] Filed: Jun. 11, 1990

[51] Int. Cl.[5] ..... 346 1.1; 346 134; 346 136; 346 108; 355 310; 355 311; 355 316; 355 317; 271 3; 271 3.1; 271 4; 271 9; 271 265; 101 228; 400 578

[52] U.S. Cl. ..... 346/1.1; 346/136; 355/316; 355/317; 271/3.1; 271/9; 271/265

[58] Field of Search ..... 346/1.1, 134, 136, 108; 355/310, 311, 316, 317; 271/3, 3.1, 4, 9, 265; 101/228; 400/578

[56] References Cited

U.S. PATENT DOCUMENTS

| | | | |
|---|---|---|---|
| 3,639,053 | 1/1972 | Spear, Jr. | 355/13 |
| 4,009,957 | 3/1977 | Suzuki et al. | 156/351 |
| 4,012,139 | 3/1977 | Washio et al. | 355/13 |
| 4,318,540 | 3/1982 | Paananen et al. | 271/4 |
| 4,933,727 | 6/1990 | Mizuma et al. | 355/327 |
| 4,941,377 | 7/1990 | Ishihara et al. | 83/211 |

*Primary Examiner*—Benjamin R. Fuller
*Assistant Examiner*—Victor DeVito
*Attorney, Agent, or Firm*—Wolf, Greenfield & Sacks

[57] ABSTRACT

A system and method for directly feeding unstacked paper sheets into a printing device having a moving image conducting element with a plurality of images placed thereon for transfer to the paper and having a wait station for controlling the timing of paper transfer to the image conducting element. A continuous stream of paper sheets is directed to a printing device wait station. The rate of the movement of the paper sheets into the wait station is controlled to present each paper sheet at a predetermined rate relative to the operating speed of the image conducting element. The spacing of the leading edge of each paper sheet, as it is presented to the wait station, is made relative to the linear spacing between consecutive images on the image conducting element.

40 Claims, 1 Drawing Sheet

SYSTEM AND METHOD FOR DIRECTLY FEEDING PAPER TO PRINTING DEVICES

1. Field of the Invention

This invention relates to a system and method for feeding a continuous stream of paper to a printing device without any need for stacking and deshingling individual sheets of paper.

2. Background of Invention

It is often desirable to input paper to a printing operation in roll form. The use of a roll, rather than single sheets, allows longer intervals between reloading of the paper source. Roll feed paper, cut just prior to feeding, allows sheets to be printed in various sizes without the need to change the size of the paper loaded in the stack. The use of a paper source roll also reduces packaging waste since stacked paper sheets must be stored in a large number of individual boxes. However, most printing devices are specifically designed to accept only stacked, pre-cut sheets of paper. The stack is fed by a deshingler that removes sheets from the stack and delivers them to the printing element. This deshingler operates slowly enough to accommodate the necessary timing of print operations. However, without the deshingler to regulate feeding, the printer cannot generally operate continuously unless some other method of regulating paper feed is provided. Previous devices have dealt with the problem of providing a continuous roll source of paper to a printer, designed only for use with stacked paper sheets, by continuously cutting and adding additional sheets from the roll to this input paper stack feed unit. This method has been particularly adapted for the Xerox TM 9700 Series Laser Printer. The problem with this method is that the printer must still deshingle and individually feed sheets of paper from the stack feed unit. The result is increased, rather than decreased overall complexity and a significantly greater chance of system failure due to the need to now accurately cut and stack paper sheets from the roll as well as to subsequently unstack the sheets of paper to feed them to the printer.

Other prior art devices also particularly directed toward the Xerox TM 9700 have eliminated the need for shingling and deshingling the paper, thus allowing direct feeding, by modifying the operating software of the printer so that its timing of operation will match that of the feeding device. The problem with such an approach is that the feeding device has lessened versatility with respect to other machines while installation time and expense are increased due to the need to modify software in the printer.

SUMMARY OF THE INVENTION

It is therefore an object of the present invention to provide a system and method for continuously feeding a printing device from a continuous roll of paper material.

It is another object of this invention to provide a system and method for feeding a printing device that requires no alteration to the operating software of the device.

It is another object of this invention to provide a system and method for feeding a printing device that allows sheets of various sizes and shapes to be accurately fed and printed upon.

It is another object of this invention to provide a system and method for feeding a printing device that requires no shingling or deshingling of the paper between the source and the printer's image conducting belt or drum.

It is yet another object of this invention to provide a system and method for feeding a printing device that is specifically applicable to the Xerox TM 9700 Laser Printer, but may also be adaptable to a variety of other printers.

The present invention provides a system and method for directly feeding unstacked paper sheets into a printing device having moving image conducting element with a plurality of images for transfer to the paper placed thereon and also having a wait station for controlling the timing of paper transfer to the image conducting element. The system comprises a means for directing a continuous stream of paper sheets to a printing device wait station. There is a means for controlling the rate of movement of the paper sheets into the wait station to present each paper sheet at a predetermined time relative to the operating speed of an image conducting element of the printing device. Means are provided for regulating the spacing of a leading edge of each paper sheet as it is present to the wait station. This spacing is relative to the spacing between consecutive images on the image conducting element.

In a preferred embodiment, the printing device is a laser printer and the image conducting element is one of either a constant speed belt or drum, upon which, images are placed for transfer. This system may be particularly adapted to a Xerox TM 9700 series laser printer. There may be provided a means for controlling the rate of paper sheet feeding that includes a predetermined rate equal to approximately 20 inches per second and a means for regulating the spacing of fed paper sheets that includes a spacing equal to approximately 10 inches. The system may also comprise a means for cutting the paper sheets to predetermined sizes from the input of a continuous paper web. This continuous paper web may be input from a roll. There may be included in this system a means for driving the roll in synchronization with the means for directing the paper sheets so that each cut paper sheet proceeds without delay to the wait station. The means for regulating paper spacing may include a means for detecting the leading edge of each paper sheet.

A method for directly feeding unstacked paper sheets according to this invention may comprise the step of directing a continuous stream of paper sheets to a printing device wait station. The rate of movement of the paper sheets is then controlled so that each paper sheet is presented to the wait station at a predetermined rate relative to the operating speed of the image conducting element of the printing device. The spacing of each of these sheets of paper is also regulated so that each sheet is presented to the wait station with a spacing relative to the linear spacing between consecutive images on the image conducting element.

BRIEF DESCRIPTION OF THE DRAWINGS

The foregoing objects and advantages of the present invention will be more clearly understood in connection with the accompanying drawings in which.

DETAILED DESCRIPTION OF THE PREFERRED EMBODIMENT

Figure 1:
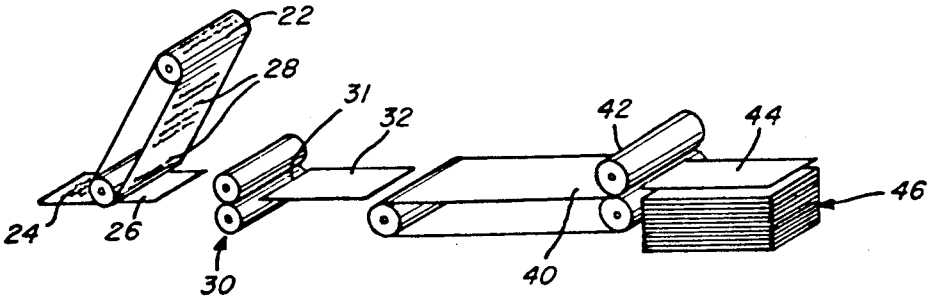
Fig. 1 (PRIOR ART)
FIG. 1 is a schematic illustration of a prior art method of feeding paper requiring deshingling of stacked sheets.

A photoreprographic printing system of the prior art is generally depicted in FIG. 1. This type of printing system is used, for example, in the Xerox TM 9700 Series Laser Printer. It generally consists of an image conductor element 22 comprising either a belt or drum upon which printing toner is placed in the form of the desired print images. The image conductor belt 22 shown herein contains several images 28 that are laid down at 24 upon a piece of paper 26 as it passes under the contacting surface of the belt. Each piece of paper is fed to the image element by means of a "wait station". This wait station includes a pair of rollers that forcibly drive a sheet of paper into the image element at a given time corresponding to the motion of the image conductor belt. The wait station 30 is synchronized to drive the leading edge 31 of a sheet of paper 32 into the image conductor belt each time an image on the image conductor belt 22 is aligned to properly print upon the sheet of paper when it reaches the image conductor belt. The feeding of the wait station, as shown in FIG. 1, is accomplished in most printer systems by deshinqling a stack of paper 46, one sheet at a time, and feeding each sheet 44 at a predetermined rate to the wait station 30, using a feed driving belt and pinching roller 40 and 42, respectively. As each sheet is fed to the wait station it is held for a small interval until the image element is again ready to receive a new piece. If the wait station does not receive a new piece of paper by the time the next image is ready to be printed, the system will shut down displaying a jam or paper refill signal.

Any feeding system that correctly interfaces with this type of printer must be able to directly feed the wait station of the printing element so that it receives a sheet of paper within the correct period of time to prevent the wait station from indicating an error. Also, it must not feed too quickly since this would cause a feeding backlog at the wait station.

Figure 2:
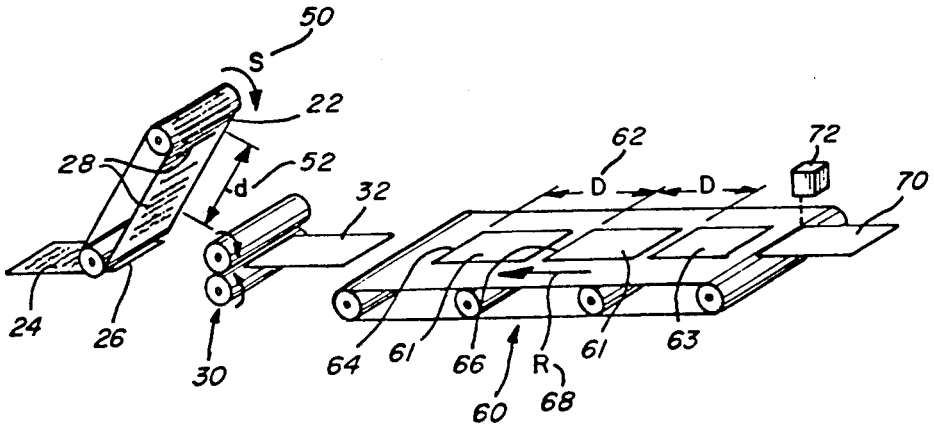
FIG. 2 is a schematic illustration of a direct feeding system according to this invention.

Reference is now made to a direct feeding system as depicted in FIG. 2 and as in accordance with the present invention. In this schematic drawing, paper sheets 70 are fed to a conveying or feeding 60 that moves paper at a specific rate R 68 to the wait station 30. Each sheet is delivered to the station 30 at a specific point of time in order to insure that it be fed to the image conducting belt 22 in synchronization with the print images laid down on the belt. In order to insure that this precise synchronization be obtained, the parameters of image conducting belt speed S 50 and the distance between the leading edge of each new image d 52 on the image conducting belt is determined. These parameters are directly relative to the feeding speed. In the example of a Xerox TM 9700 Laser Printer, the image belt speed is 20 inches per second and the distance between each image leading edge D is 10 inches. As such, the system 60 is designed to separate each leading edge of input paper sheets by a distance D 62 that equals the image conducting belt image distance d 52. In this case, the distance is 10 inches.

In FIG. 2 the leading edges 64 and 66 of each paper sheet 61 are separated by the distance D. This spacing may be accomplished by detecting at 72 the leading edge of a sheet each time a sheet is presented to a feeding mechanism or conveyor 60. Each sheet is motioned down the feeding mechanism 60 when the appropriate distance from the preceding leading edge has been attained. Furthermore, each sheet of paper driven at this distance D travels down the feeding mechanism at a fixed rate R 68. In this example, the rate R will equal 20 inches per second, or the rate of the image conducting belt. The advantage of such a leading edge detect system is that various sizes of paper may be aligned to print accurately since each sheet is fed accurately with timing of feed based solely upon its own leading edge. As shown in FIG. 2, the second sheet 61 and third sheet 63 are of different sizes while each sheet's leading edge is aligned at precisely the same distance from the preceding one. The system only allows the next sheet to begin motion when the preceding leading edge has travelled exactly a distance D from the next sheet's leading edge. Since printing may occur without regard to size, the printing of unfolded envelopes, among other applications, is possible in large unstacked volume.

Figure 3:
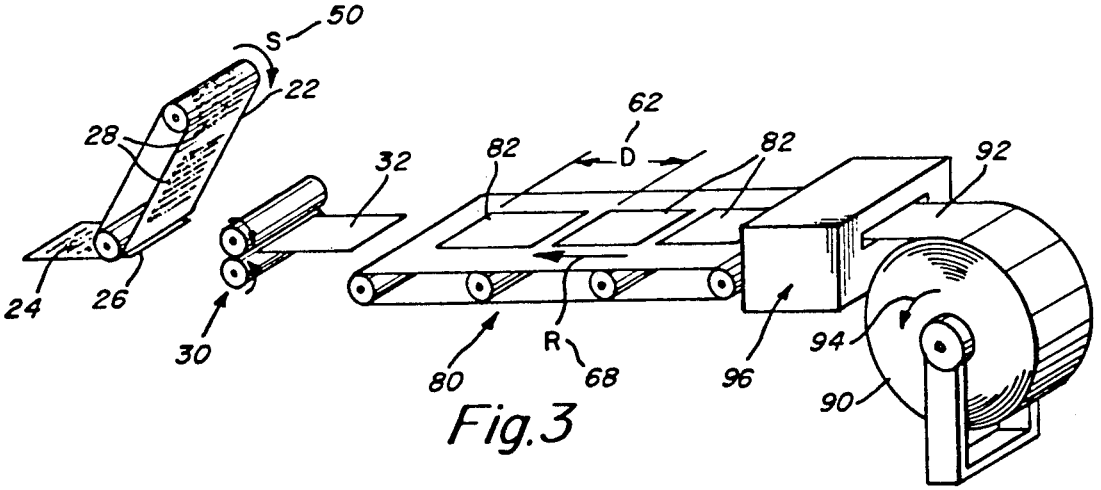
FIG. 3 is a schematic illustration of the direct feeding system of FIG. 2 including a paper feeding roll and sheet cutting device for increased production volume.

A significant feature of the direct feeding concept is the ability to input a continuous web of paper to the printing system. A roll 90 of paper web 92 is shown in FIG. 3. This paper web 92 is fed in a continuous manner into a cutting unit 96 The cutting unit 96 cuts sheets to a predetermined size sheet 82 that are then driven down the feeding device 80 with the required spacing D 62. The sheets are then delivered by the feeding mechanism or conveyor 80 to the wait station 30 and printed upon in the manner described herein above. The feed rate of the roll 94 to the cutting device 96 is synchronized to the general feed rate of the feeding mechanism 80. If so, each time a sheet is cut it may proceed on to the feeding device without delay.

In accordance with the invention, the station 30 may operate continuously assuming that the spacing D is proper as introduced to the station 30. Alternatively, the station 30 may operate somewhat intermittently with a slight wait possible for proper synchronization. Sheets can be provided early to the station 30 but cannot be provided late as this would cause a malfunction and shut-down.

As indicated previously, in accordance with the present invention, each sheet of paper, such as illustrated in FIG. 2, is carried by the feeding mechanism or conveyor 60 once the appropriate distance from the preceding leading edge has been attained. Assuming that the feeding mechanism 60 is set up for operation at a predetermined speed to match that of the image conducting belt 22, then one can employ a leading edge detector to determine the presence of a leading edge of a sheet being fed to the feeding device 60. Once this leading edge is detected, the input feed to the feeding mechanism 60 can be interrupted until the proper spacing occurs, namely the spacing D in FIG. 2 at which time the input feed proceeds so that all leading edges are spaced the proper predetermined distance, namely distance D in FIG. 2.

By way of further example, there can be separate feeding mechanisms, including an origination feeding mechanism and a feeding mechanism such as the conveyor like feeding mechanism 60 shown in FIG. 2. The leading edge detector would, in essence, be between these two feeding mechanisms and would in essence take input sheets fed in a serial course that might be unsynchronized positionally and essentially convert the sheets into a synchronized positional arrangement on the feeding mechanism 60. Again, this occurs by detecting leading edges on the input feed mechanism and then permitting the sheets to be fed to the feeding mechanism 60 but only once the proper spacing D has been achieved.

Figure 4:
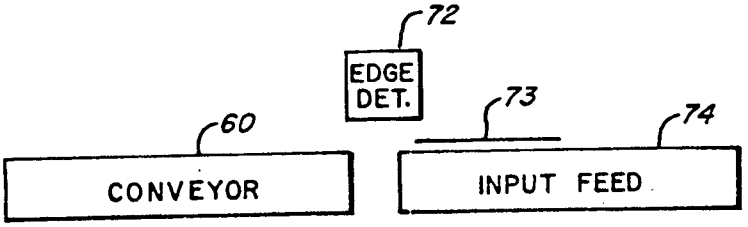
FIG. 4 schematically illustrates an edge detector used with the feed mechanism in accordance with the present invention.

Now, with regard to the synchronization of sheets onto the feeding mechanism or conveyor 60, refer to FIG. 4 which is a schematic diagram illustrating the conveyor 60 as well as an input feed 74, and edge detector 72, and a typical sheet 73. The sheet 73 is fed on the input feed. The edge detector 72 detects an edge of this sheet and essentially holds the sheet in readiness for the conveyor 60 moving to particular position at which time the sheet 73 continues to be fed onto the conveyor 60 with the proper spacing between sheets as illustrated in FIG. 2 by the spacing D.

It should be understood that the preceding is merely a detailed description of a preferred embodiment. It will be obvious to those skilled in the art that various modifications can be made without departing from the spirit or scope of the invention. The preceding description is meant to describe only a preferred embodiment and not to limit the scope of the invention.

What is claimed is:

1. A method for directly feeding a continuous stream of unstacked sheets into a printing device through a port of the printing device adapted for utilizing precut sheets from a stack and having a moving image conducting element with images for transfer to sheets placed thereon, said method comprising the steps of:

directing a continuous stream of sheets from a source external of said device port for feeding precut sheets to a printing device wait station that drives each sheet into contact with an image conducting element at a time that enables printing of a predetermined image thereon, said directing of sheets including bypassing of an integral sheet stack feeder storage unit and sheet deshingler that normally feeds sheets from a stack to the port and said directing being operated by a means for recognizing a printing device request independent of image conducting element and wait station control;

controlling a rate of movement of said sheets directed to said port to present each sheet to said wait station at a predetermined time relative to an operating speed of the image conducting element of said printing device; and regulating spacing of a leading edge of each sheet as the sheet is directed to said port, said spacing being a function of a linear spacing between consecutive images on said image conducting element.

2. The method of claim 1 wherein said printing device is a laser printer.

3. The method of claim 1 wherein said image conducting element includes a constant speed image conducting belt to which and from which images are transferred.

4. The method of claim 2 wherein said printing device is a high volume production laser printer adapted to deshingle and feed sheets one at a time from a stack having a storage capacity of more than 5000 sheets and having automatic misfeed detection means that ceases operation of the image conducting element in response to a sensing of no sheet at said wait station at said predetermined time.

5. The method of claim 4 wherein said step of controlling the rate includes a predetermined rate equal to approximately 20 inches per second.

6. The method of claim 5 wherein said step of regulating the spacing includes a spacing equal to approximately 10 inches.

7. The method of claim 1 further comprising the step of cutting, at a location upstream in a feeding direction of said port, said sheets to predetermined sizes from an input continuous web at a time prior to each of said sheets being presented to said wait station.

8. The method of claim 7 wherein said continuous web is input from a roll position upstream in a feeding direction of said port.

9. The method of claim 8 further comprising the step of driving said roll in synchronization with said directing step in response to said directing so that each cut sheet may proceed without delay to said wait station.

10. The method of claim 1 wherein said step of regulating further includes the step of detecting the leading edge of each sheet to allow holding of each sheet in place until a preceding sheet is positioned by the directing step so that a leading edge of the preceding sheet is spaced from the leading edge of the held sheet at a distance equal to said spacing.

11. A system for directly feeding a continuous stream of unstacked sheets into a printing device having a port of the device adapted for utilizing precut sheets from a stack and having a moving image conducting element with images for transfer to sheets placed thereon, said system comprising:

means for directing a continuous stream of sheets from a source external of said device port for feeding precut sheets to a printing device wait station that drives each sheet into contact with an image conducting element at a time that enables printing of a predetermined image thereon, said means for directing including means for bypassing an integral sheet stack feeding storage unit and sheet deshingler that normally feeds sheets to said port from a stack, said means for directing including operating means for recognizing a printing device print request independent of controls from said image conducting element and wait station;

means for controlling said means for directing to enable a rate of movement of said sheets into said port at a predetermined time relative to an operating speed of the image conducting element of said printing device; and means for regulating spacing of a leading edge of each sheet in said means for directing as the sheet is presented to said port, said spacing being a function of a linear spacing between consecutive images on said image conducting element.

12. The system of claim 11 wherein said printing device is a laser printer.

13. The system of claim 11 wherein said image conducting element includes a constant speed image conducting belt to which and from which images are transferred.

14. The system of claim 12 wherein said printing device is a high volume production laser printer adapted to deshingle and feed sheets one at a time from a stack having a storage capacity of more than 5000 sheets and having automatic misfeed detection means that ceases operation of the image conducting element in response to a sensing of no sheet at said wait station at said predetermined time.

15. The system of claim 14 wherein said means for controlling the rate includes a predetermined rate equal to approximately 20 inches per second.

16. The system of claim 15 wherein said means for regulating the spacing includes a spacing equal to approximately 10 inches.

17. The system of claim 11 further comprising means, positioned at a location downstream in a feeding direction of said port, for cutting said sheets to predetermined sizes from an input continuous web at a time prior to arrival of each of the sheets at the wait station.

18. The system of claim 17 wherein said continuous web is input from a roll position upstream in a feeding direction of said port.

19. The system of claim 18 further comprising means for driving said roll in synchronization with and in response to said means for directing so that each cut sheet may proceed without delay to said wait station.

20. The system of claim 11 wherein said means for regulating includes means for detecting the leading edge of each sheet and means for holding each sheet in response to means for detecting until a leading edge of a preceding sheet is positioned by the means for directing at a distance from said leading edge of the held sheet equal to said spacing.

21. A system for feeding sheets to a printing device having a moving image transfer element and having a port adapted for normally receiving sheets from a stack and transferring said sheets to said image transfer element, said system comprising, means for recognizing a printing device print request, a means for feeding sheets to the port at a constant rate and with equal spacing between each of the sheets during operation thereof and including means for bypassing an integral sheet storage stack and a stack sheet deshingler that normally feeds sheets to said port, means for operating said means for feeding in response to said means for recognizing, said means for operating being independently controllable from said image transfer element, means for controlling sheet feed to said image transfer element from said means for feeding so as to regulate spacing between leading edges of successive sheets to make the spacing constant and equal to the distance between leading edges of successive images on said image transfer element, and source means for intermittently transferring sheets to said means for feeding in response to the operation of said means for feeding.

22. A system as set forth in claim 21 in combination with an input feed means for feeding sheets in roll form and cutting means for cutting the sheets for presentation to said means for feeding, said input feed means and said cutting means each being positioned upstream in a feeding direction of said port and presenting sheets to said means for feeding in response to the operation of said means for feeding.

23. A system as set forth in claim 22 further including control means for driving said roll in synchronism with the operation of said means for feeding so that each sheet proceeds without delay to the printing device.

24. A system as set forth in claim 21 wherein said means for feeding includes means for detecting the leading edge of each sheet and means for holding each sheet until a preceding sheet has moved toward said port sufficiently for a leading edge of the preceding sheet to be positioned at a distance from the leading edge of the held sheet at a distance 25. A system as set forth in claim 24 including an input feed means for feeding sheets in combination with a leading edge detector for detecting the leading edge of each sheet, said input feed means operated in synchronism with said means for feeding so as to regulate spacing between leading edges of said successive sheets.

26. In an apparatus for printing sheets having an image transfer element that transfers images to input sheets at a predetermined rate, an image transfer element feed unit that operates in response to operation of the image transfer element and controls the rate and positioning of each input sheet relative to the image transfer element so as to feed each sheet in proper synchronization with the image transfer element and that signals a misfeed condition in response to the sensing of an absence of a sheet at the feed unit at a time in which the feed unit operates to feed a sheet, a port into which sheets are input successively to engage the feed unit, said sheets being delivered to said port exclusively from a storage stack of sheets by means of a stack deshingler, the improvement comprising:

print instruction recognition means for generating an operation signal in response to a printing device print request;

means positioned at and extending upstream in a feeding direction of the port, for directing a stream of at least two sheets having predetermined spacing and having a constant rate of movement directly to the port while bypassing the storage stack and sheet deshingler, said means for directing operating in response to the operation signal of the print instruction recognition means;

means for controlling the rate of operation of the means for directing so that a leading edge of each sheet reaches the port at a time synchronized with a rate of operation of the image transfer element;

means for regulating spacing between succeeding leading edges of each sheet carried by the means for directing to correspond to spacing of images on the image transfer element;

source means, positioned upstream of the means for directing, for intermittently transferring sheets to said means for directing in response to the operating of said means for directing; and means for operating each of the means for directing, means for controlling and means for regulating by means of an internal programmed control routine.

27. An apparatus as set forth in claim 26 wherein said source means includes means for cutting each of the sheets from a 28. An apparatus as set forth in claim 27 wherein the source means includes roll support means for storing said continuous web in roll form positioned upstream of the means for cutting.

29. An apparatus as set forth in claim 28 wherein said roll support means further comprises means for driving the roll to feed continuous web to the means for cutting in response to the means for directing.

30. A system for feeding sheets to a printing device having a moving image transfer element and having a port adapted for exclusively receiving sheets from a stack and a stack sheet deshingler and feeder for transferring said sheets from said stack to said image transfer element at a time that synchronizes each transferred sheet with printing of an image by the transfer element, said system comprising:

means for determining a start of operation of the image transfer element;

conveyor means for concurrently carrying and transferring at least two spaced sheets in succession directly to the port of the printing device, each of said sheets being fed at a predetermined rate and spacing along said conveyor means relative to each other, said conveyor means including bypass structure means for bridging a distance within said printing device between said printing device sheet stack deshingler and said image transfer element;

independent controller means including a preprogrammed control routine for driving said conveyor means at the predetermined rate, said controller means beginning operation in response to a signal from said means for determining; and means for cutting and inputting sheets to said conveyor means from a leading end of a continuous web source, said means for cutting and inputting including sheet leading edge detect means for holding and releasing each sheet onto said conveyor means at a time that maintains the predetermined spacing of sheets upon said conveyor means, said predetermined rate and spacing between sheets upon said conveyor being proportional to a rate of printing of said image transfer element and a spacing between images upon said image transfer element.

31. The system as set forth in claim 30 wherein the continuous web source comprises a roll of web.

32. The system as set forth in claim 31 wherein the printing device comprises a high volume production laser printer adapted to deshingle and feed sheets one at a time from a stack having a storage capacity of more than 5000 sheets and having automatic misfeed detection means that ceases operation of the image transfer element in response to a sensing of an absence of a sheet at the port a time wherein the image transfer element is positioned to print an image upon a sheet.

33. The system as set forth in claim 30 wherein the predetermined spacing is a constant spacing and wherein the predetermined rate is a constant rate.

34. The system as set forth in claim 30 wherein the conveyor means is a substantially flat horizontally disposed surface with sheets transferred horizontally therealong.

35. The system as set forth in claim 30 wherein the leading edge detect means is positioned between the means for cutting and inputting sheets and the conveyor means to sense the positioning of a sheet leading edge as the leading edge is positioned between the means for cutting and inputting sheets and the conveyor means.

36. The system as set forth in claim 35 wherein the means for cutting and inputting includes a blade means for separating each sheet from the continuous web, the blade means positioned at a predetermined sheet length related distance upstream of the leading edge detect means whereby each sheet is cut from the continuous web as it is held in response to the leading edge detect means.

37. The method as set forth in claim 1 wherein the directing step comprises transferring a plurality of sheets along a substantially flat horizontally disposed surface. each of the sheets having a constant spacing relative to others of the sheets upon the surface.

38. The system as set forth in claim 11 wherein the means for directing comprises a substantially flat horizontally disposed surface for transferring a plurality of sheets, each of the sheets having a constant spacing relative to others of the sheets upon the surface.

39. The system as set forth in claim 21 wherein the means for feeding comprises a substantially flat horizontally disposed surface for transfer of a plurality of sheets having the equal spacing between each other thereon.

40. The apparatus as set forth in claim 26 wherein the means for directing comprises a substantially flat horizontally disposed surface for conveying the sheets thereon.

* * * * *